US010596690B2

(12) United States Patent
Weigmann et al.

(10) Patent No.: US 10,596,690 B2
(45) Date of Patent: Mar. 24, 2020

(54) DRIVING TOOL FOR DRIVING FASTENING MEANS INTO A WORKPIECE

(71) Applicant: ILLINOIS TOOL WORKS INC., Glenview, IL (US)

(72) Inventors: Torsten Weigmann, Ronnenberg (DE); Klaus Von Soest, Winzenburg (DE); Olaf Haehndel, Plattensen (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 619 days.

(21) Appl. No.: 14/898,562

(22) PCT Filed: Apr. 23, 2014

(86) PCT No.: PCT/US2014/035111
§ 371 (c)(1),
(2) Date: Dec. 15, 2015

(87) PCT Pub. No.: WO2014/209482
PCT Pub. Date: Dec. 31, 2014

(65) Prior Publication Data

US 2016/0114470 A1 Apr. 28, 2016

(30) Foreign Application Priority Data

Jun. 25, 2013 (DE) ..... 10 2013 106 657

(51) Int. Cl.
*B25C 1/04* (2006.01)
*B25C 1/00* (2006.01)

(52) U.S. Cl.
CPC ..... *B25C 1/043* (2013.01); *B25C 1/008* (2013.01); *B25C 1/04* (2013.01); *B25C 1/047* (2013.01)

(58) Field of Classification Search
CPC ..... B25C 1/043; B25C 1/047; B25C 1/008; B25C 1/04; B25C 1/06; B25C 1/044–1/046; B25C 1/123
(Continued)

(56) References Cited

U.S. PATENT DOCUMENTS 3,467,294 A * 9/1969 Fisher ..... B25C 1/041 227/8
3,479,926 A * 11/1969 Malcolm ..... B25C 1/041 91/404

(Continued)

FOREIGN PATENT DOCUMENTS

CN 1788940 A 6/2006
CN 101284374 A 10/2008

(Continued)

OTHER PUBLICATIONS

ISR and WO for PCT/US2014/035111 dated Aug. 11, 2014, 10 pages.

*Primary Examiner* — Alexander M Valvis
*Assistant Examiner* — Katie L Gerth
(74) *Attorney, Agent, or Firm* — Neal, Gerber & Eisenberg LLP

(57) ABSTRACT

This disclosure relates to a driving tool for driving fastening means into a workpiece, an actuator unit allows the fastening means to be driven into the workpiece in driving-in cycles, a triggering assembly triggers the driving-in cycles of the actuator unit and a workpiece contact element, which is actuated by placing the driving tool onto the workpiece. The tool is operable in single shot mode. Each sequence of an actuation of the workpiece contact element with subsequent actuation of a trigger lever triggers a driving-in cycle. The tool is operable in a bump firing mode, in which, with the trigger lever continuously actuated, each actuation of the workpiece contact element triggers a driving-in cycle, a (Continued)

Figure 1:
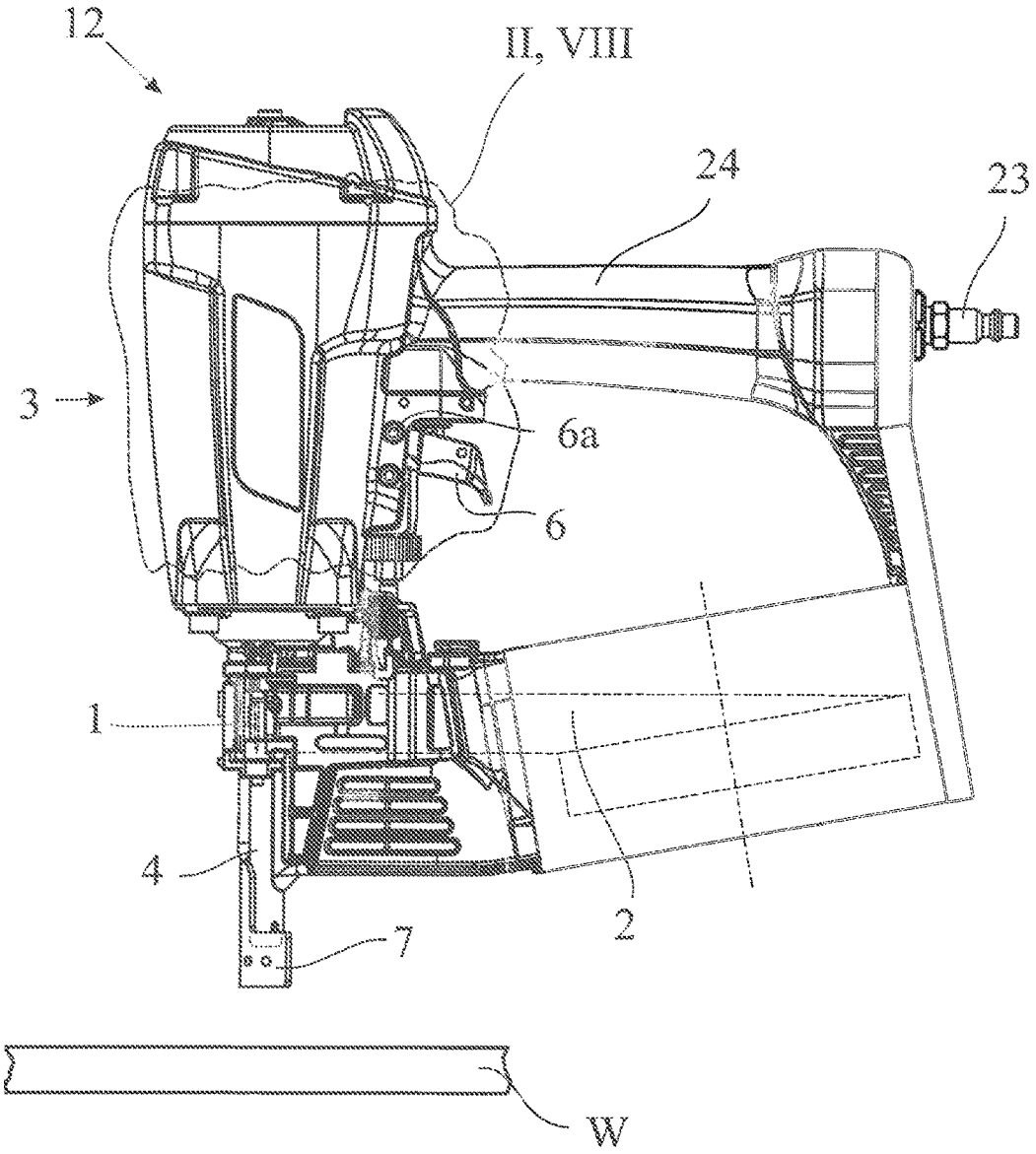

resetting assembly, which can be activated in the bump firing mode and, after a delay time starting from the activation, results in transferring the tool from the bump firing mode into the single shot mode.

17 Claims, 13 Drawing Sheets

(58) Field of Classification Search
USPC ..... 227/8
See application file for complete search history.

(56) References Cited

U.S. PATENT DOCUMENTS 3,572,572 A * 3/1971 Readyhough ..... B25C 1/008 227/8
3,580,455 A * 5/1971 Cast ..... B25C 1/008 227/8
3,583,496 A * 6/1971 Fehrs ..... B25C 1/043 173/15
3,786,978 A 1/1974 Manganaro
3,964,659 A * 6/1976 Eiben ..... B25C 1/008 227/8
4,351,464 A 9/1982 Fehrs
4,550,643 A * 11/1985 Schwartzenberger .. B25C 1/043 227/8
4,679,719 A 7/1987 Kramer
5,191,861 A 3/1993 Kellerman et al.
5,197,646 A 3/1993 Nikolich
5,551,620 A 9/1996 Vallee
5,605,268 A 2/1997 Hayashi et al.
5,687,897 A * 11/1997 Fa ..... B25C 1/043 227/8
5,732,870 A 3/1998 Moorman et al.
5,772,096 A 6/1998 Osuka et al.
5,862,969 A 1/1999 Lee
5,918,788 A 7/1999 Moorman et al.
6,095,392 A * 8/2000 Batts, Jr. ..... B25C 1/008 227/130
6,123,241 A 9/2000 Walter
6,213,372 B1 4/2001 Chen
6,357,647 B1 3/2002 Ou
6,371,348 B1 4/2002 Canlas et al.
6,382,492 B1 5/2002 Moorman et al.
6,431,425 B1 8/2002 Moorman et al.
6,450,387 B1 9/2002 Chen
6,543,664 B2 4/2003 Wolfberg
6,604,664 B2 * 8/2003 Robinson ..... B25C 1/008 227/120
6,691,907 B1 2/2004 Chang
6,695,193 B1 2/2004 Chang
6,695,194 B1 2/2004 Chang
6,857,547 B1 2/2005 Lee
7,070,080 B2 7/2006 Lin
7,143,918 B2 12/2006 Aguirre et al.
7,163,134 B2 1/2007 Moeller et al.
7,191,927 B2 * 3/2007 Segura ..... B25C 1/008 227/142
7,196,688 B2 3/2007 Schena
7,383,974 B2 6/2008 Moeller
7,469,811 B2 12/2008 Shima et al.
7,469,818 B2 12/2008 Saltsor et al.
7,510,105 B2 3/2009 Moeller et al.
7,513,402 B2 4/2009 Miyashita
7,828,072 B2 11/2010 Hashimoto et al.
7,938,305 B2 5/2011 Simonelli et al.
7,971,766 B2 7/2011 Tang
7,975,890 B2 7/2011 Tang
8,011,441 B2 9/2011 Leimbach et al.
8,011,547 B2 9/2011 Leimbach et al.
8,313,012 B2 * 11/2012 Shima ..... B25C 1/06 173/117
8,336,749 B2 12/2012 Largo
8,348,118 B2 1/2013 Segura
9,061,407 B2 6/2015 Chien et al.
9,242,359 B2 1/2016 Staples
9,381,663 B2 7/2016 Maurer
9,486,907 B2 11/2016 Birk
9,550,288 B2 1/2017 Moore et al.
9,782,879 B2 10/2017 Baur
9,782,880 B2 10/2017 Moore et al.
10,213,911 B2 2/2019 Moore et al.
2001/0006183 A1 * 7/2001 Mukoyama ..... B25C 1/008 227/8
2002/0130154 A1 9/2002 Wolfberg
2002/0185514 A1 12/2002 Adams et al.
2003/0121947 A1 7/2003 Hsu
2004/0045997 A1 3/2004 Birk
2005/0023318 A1 2/2005 Aguirre et al.
2005/0029323 A1 * 2/2005 Shima ..... B25C 1/008 227/10
2005/0173484 A1 8/2005 Moeller
2005/0173487 A1 8/2005 Moeller et al.
2005/0217874 A1 * 10/2005 Forster ..... B25C 1/06 173/1
2005/0217875 A1 * 10/2005 Forster ..... B25C 1/06 173/1
2005/0220445 A1 * 10/2005 Baskar ..... B25C 1/06 388/811
2007/0004984 A1 1/2007 Crum
2007/0131731 A1 6/2007 Moeller
2007/0278275 A1 * 12/2007 Ho ..... B25C 1/008 227/8
2008/0073405 A1 * 3/2008 Shima ..... B25C 1/06 227/131
2008/0251558 A1 10/2008 Suda
2009/0057365 A1 * 3/2009 Murayama ..... B25C 1/08 227/10
2009/0159633 A1 6/2009 Wu
2009/0236387 A1 9/2009 Simonelli
2009/0242604 A1 * 10/2009 Mina ..... B25C 1/047 227/8
2009/0250500 A1 * 10/2009 Brendel ..... B25C 1/06 227/132
2009/0314818 A1 * 12/2009 Segura ..... B25C 1/008 227/8
2010/0116863 A1 * 5/2010 Suda ..... B25C 1/008 227/8
2010/0173686 A1 7/2010 Grant
2010/0236911 A1 9/2010 Wild
2010/0237124 A1 * 9/2010 Shima ..... B25C 1/06 227/8
2010/0243699 A1 * 9/2010 Largo ..... B25C 1/08 227/2
2012/0022525 A1 1/2012 Dietz
2012/0041436 A1 2/2012 Ullrich
2012/0097730 A1 4/2012 Liang et al.
2012/0104070 A1 5/2012 Wu et al.
2012/0118932 A1 * 5/2012 Largo ..... B25C 1/005 227/8
2012/0138658 A1 6/2012 Ullrich
2012/0298390 A1 11/2012 Schieler
2013/0041368 A1 2/2013 Cunningham
2013/0062390 A1 3/2013 Yeh
2017/0050305 A1 2/2017 Birk
2019/0184536 A1 6/2019 Moore et al.

FOREIGN PATENT DOCUMENTS

CN 101743099 A 6/2010
DE 202013001537 U1 3/2013
EP 0736360 10/1996
EP 1223009 7/2002
EP 1240982 9/2002
EP 1980367 10/2008
EP 2450152 9/2012
JP H08276375 10/1996
JP 2002346946 A 12/2002
WO WO 02/051591 7/2002

* cited by examiner

DRIVING TOOL FOR DRIVING FASTENING MEANS INTO A WORKPIECE

RELATED APPLICATIONS

The present application is a National Phase of International Application Number PCT/US2014/035111 filed Apr. 23, 2014 and claims priority to German Application Number 10 2013 106 657.7 filed Jun. 25, 2013.

FIELD

The present invention relates to a driving tool for driving fastening means into a workpiece and to a driving tool for driving in fastening means.

BACKGROUND

In the case of the known driving tool, a time-delayed, automatic resetting from the bump firing mode into the single shot mode is provided. For this, the driving tool has a resetting assembly with a control volume. The resetting assembly can be activated in the bump firing mode, by air at a working pressure being admitted into the control volume. The control volume is provided with an air-venting opening, which allows slow venting of the air. If the pressure goes below a limit value, this has the effect after a predetermined delay time of transferring the driving tool into the single shot mode. A separate valve, the valve piston of which is coupled to the workpiece contact element, is provided for the activation of the resetting assembly. An actuation of the workpiece contact element consequently leads to an activation of the resetting assembly. This is intended to achieve the effect that, when the driving tool is not used over a certain delay time, the driving tool is transferred from the bump firing mode into the single shot mode.

SUMMARY

A driving tool is used primarily as a handheld tool, for example for fastening particle boards on supporting structures. The term "fastening means" should be understood here in a broad sense and comprises not only nails and staples but also screws, pins or the like. The main focus of attention here is on the driving in of nails, which should not be understood as being restrictive.

The fastening means usually take the form of a magazine belt. Depending on the design, the magazine belt may for example have a carrier belt of plastic or metal, which carries the individual fastening means. Another variant is that of providing a series of parallel running fastening wires, which are tacked on to the individual fastening means.

The driving tool in question may be designed as a compressed-air-operated driving tool, as a combustion-powered driving tool or as an electrically operated driving tool or the like.

The known driving tool (U.S. Pat. No. 6,604,664 B2), on which the invention is based, is designed as a compressed-air-operated driving tool. It is provided with a pneumatic actuator unit, which serves for driving in the fastening means in individual driving-in cycles.

For triggering the driving-in cycles of the actuator unit, a triggering assembly is provided, having a trigger lever that can be actuated manually and a workpiece contact element that can be actuated by placing the driving tool onto the workpiece.

What is advantageous about the known driving tool is the fact that it can be operated in two different operating modes. In the single shot mode, each individual sequence of an actuation of the workpiece contact element (from the unactuated state of the workpiece contact element) with subsequent actuation of the trigger lever (from the unactuated state of the trigger lever) triggers a driving-in cycle. In the bump firing mode, with the trigger lever continuously actuated, each individual actuation of the workpiece contact element (from the unactuated state of the workpiece contact element) triggers a driving-in cycle.

The invention addresses the problem of designing and developing the known driving tool in such a way that the structure is simplified.

The above problem is solved in the case of a driving tool described in this disclosure.

Essential to this is the fundamental recognition that the driving-in cycle of the actuator unit itself can be used for the activation of the resetting assembly. That is also appropriate, since the delay time is in fact to be originally counted from the last firing actually performed. With the solution proposed, a malfunction of any kind, for example of the triggering assembly, cannot lead to an undesired activation of the resetting assembly.

To be specific, a special coupling of the resetting assembly to the actuator unit is proposed, that is in such a way that, in the bump firing mode, a driving-in cycle activates the resetting assembly.

As it is proposed, the term "coupling" should be understood in a broad sense. It includes a pneumatic coupling, a mechanical coupling, an electrical coupling and a sensory coupling. A sensory coupling means that a change in state of the actuator unit, in particular an adjusting movement, is detected by means of a sensor.

With the solution proposed, the function of a resetting assembly can be realized without an additional valve being required. The reason for this is that the driving-in cycle that exists in any case is itself used to activate the resetting assembly.

In the case of the particularly preferred design according to at least one embodiment, the driving tool is designed as a compressed-air driving tool, in one variant the resetting assembly being pneumatically coupled to a working cylinder of the actuator unit. This coupling between the resetting assembly and the actuator unit can be implemented structurally in a most particularly simple way.

In the case of the further preferred designs according to at least one embodiment, the resetting assembly is provided with a control volume, to which a working pressure is applied for the activation of the resetting assembly. The venting of air from the control volume takes place by way of an air-venting assembly, which is dimensioned in such a way that, after the predetermined delay time, the pressure goes below the limit value (claim 6).

In the case of the further preferred design according to at least one embodiment, a pneumatically adjustable control element is pneumatically coupled to the control volume, the pneumatically adjustable control element interacting with the triggering assembly in such a way that, when the pressure goes below the limit value, there is a transfer of the driving tool from the bump firing mode into the single shot mode.

A design that is structurally particularly compact is obtained according to at least one embodiment, by the pneumatically adjustable control element being designed as a control sleeve arranged concentrically in relation to the valve piston of the triggering valve of the triggering assembly.

According to a further teaching, which is of independent significance, a driving tool for driving in fastening means is disclosed. In principle, this is a driving tool of the kind described above, without necessarily relying on the coupling of the resetting assembly to the actuator unit in such a way that, in the bump firing mode, a driving-in cycle activates the resetting assembly.

Rather, what is essential according to the further teaching is that the resetting assembly has a control volume and a pneumatically adjustable control element, which is pneumatically coupled to the control volume. As proposed, when the pressure in the control volume goes below a limit value, the pneumatically adjustable control element interacts with the triggering assembly in such a way that, with the trigger lever actuated, an actuation of the workpiece contact element is disengaged.

What is essential according to this further teaching is therefore that, by an adjustment of the pneumatically adjustable control element, the workpiece contact element is otherwise mechanically decoupled from the triggering assembly. Such an assembly with a control volume and a pneumatically adjustable control element can be realized in a structurally simple and particularly compact way.

All of the preferred features and advantages explained here in relation to the driving tool of the first-mentioned teaching can be applied to the full extent to the driving tool according to the second teaching, without relying on the resetting assembly being coupled to the actuator unit in such a way that, in the bump firing mode, a driving-in cycle activates the resetting assembly.

Figure 2:
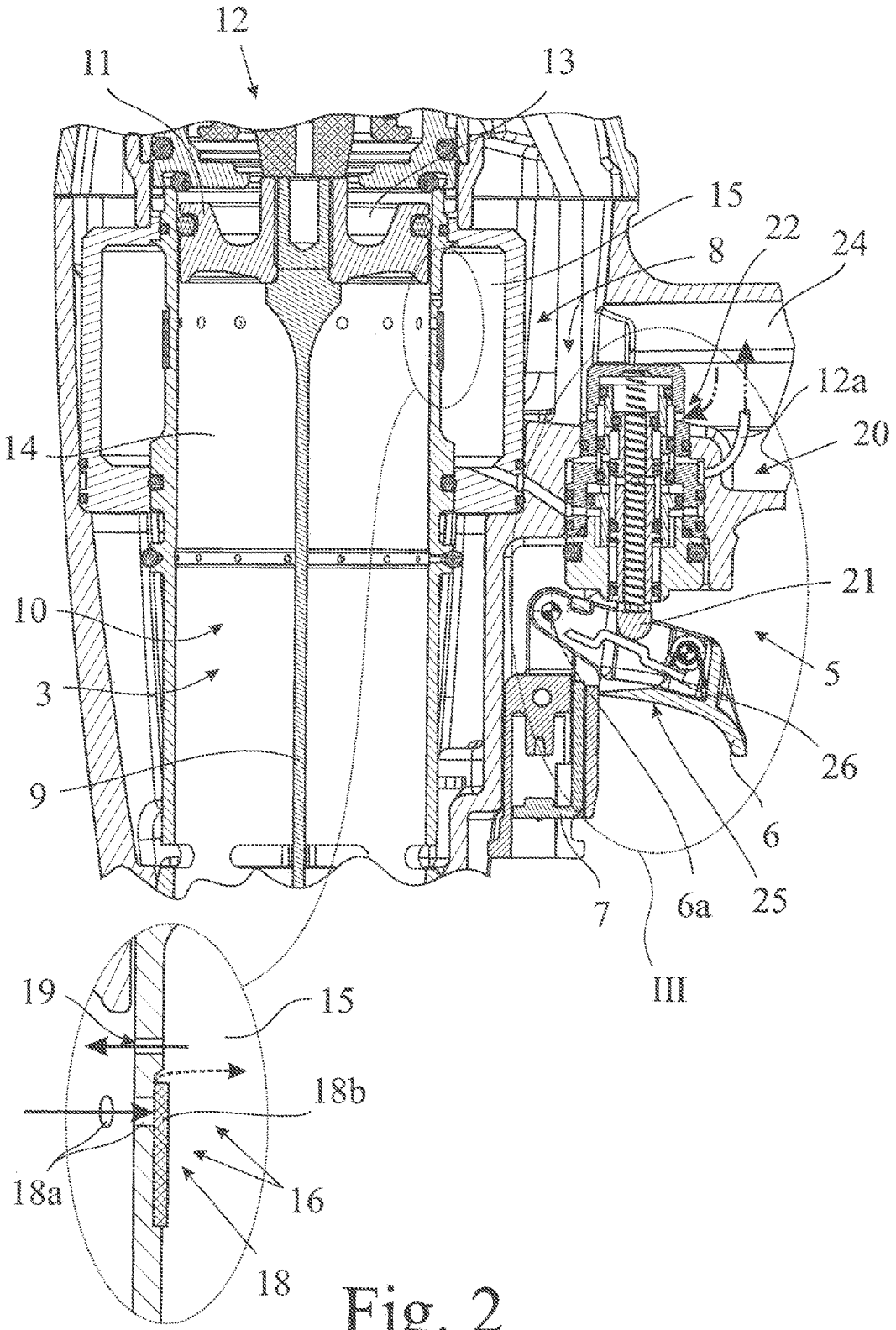
Figure 3:
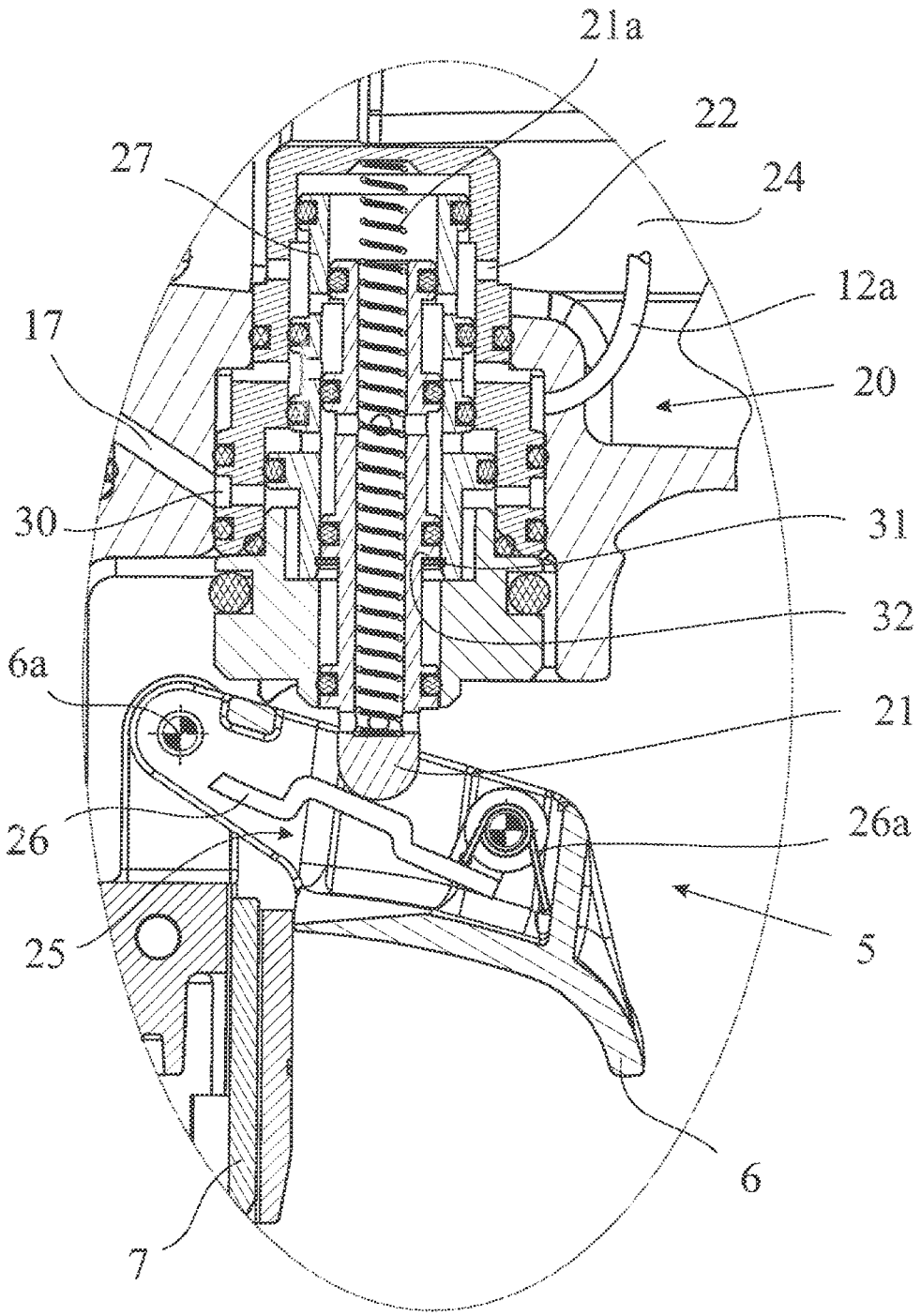
Figure 4:
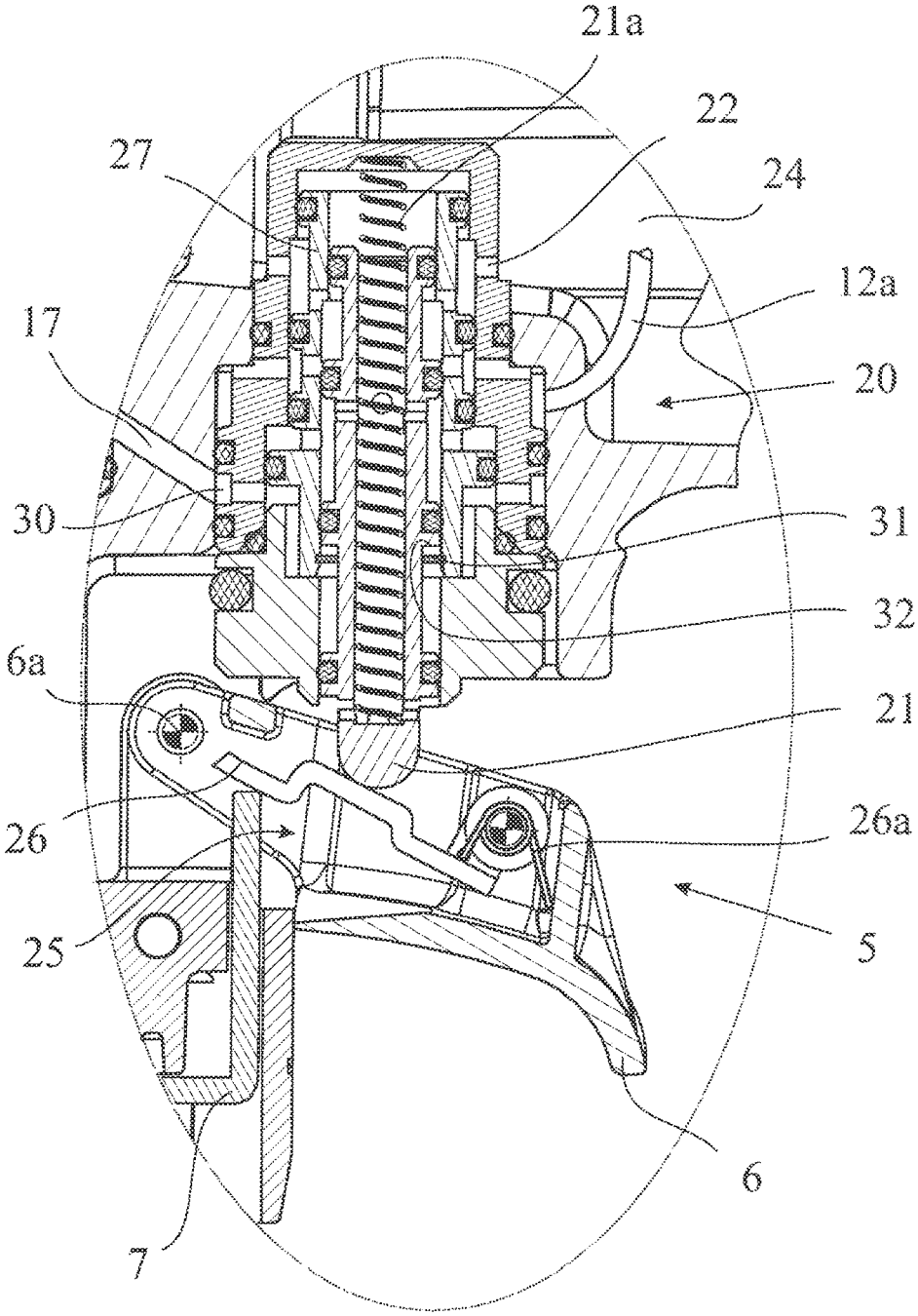
Figure 5:
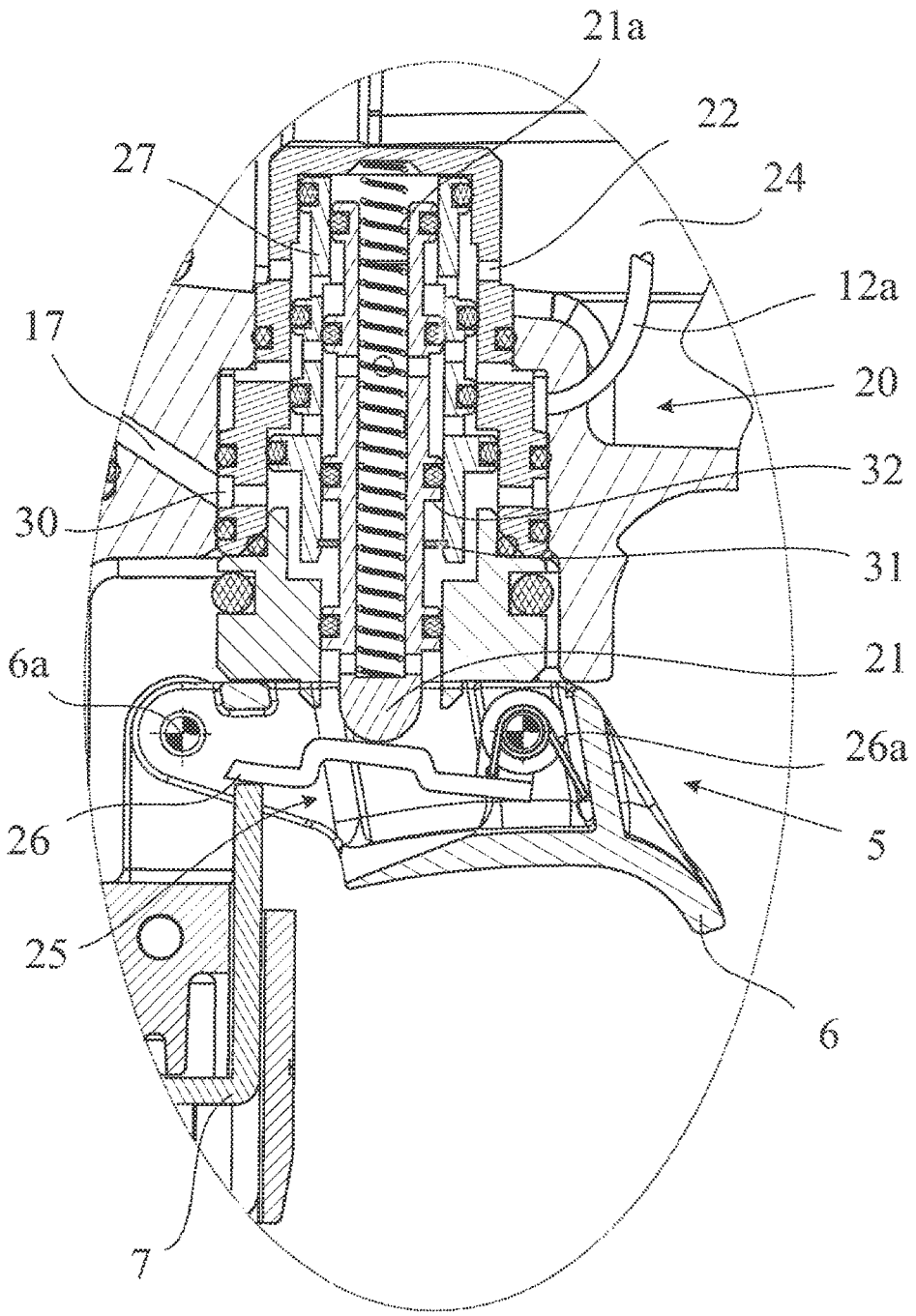
Figure 6:
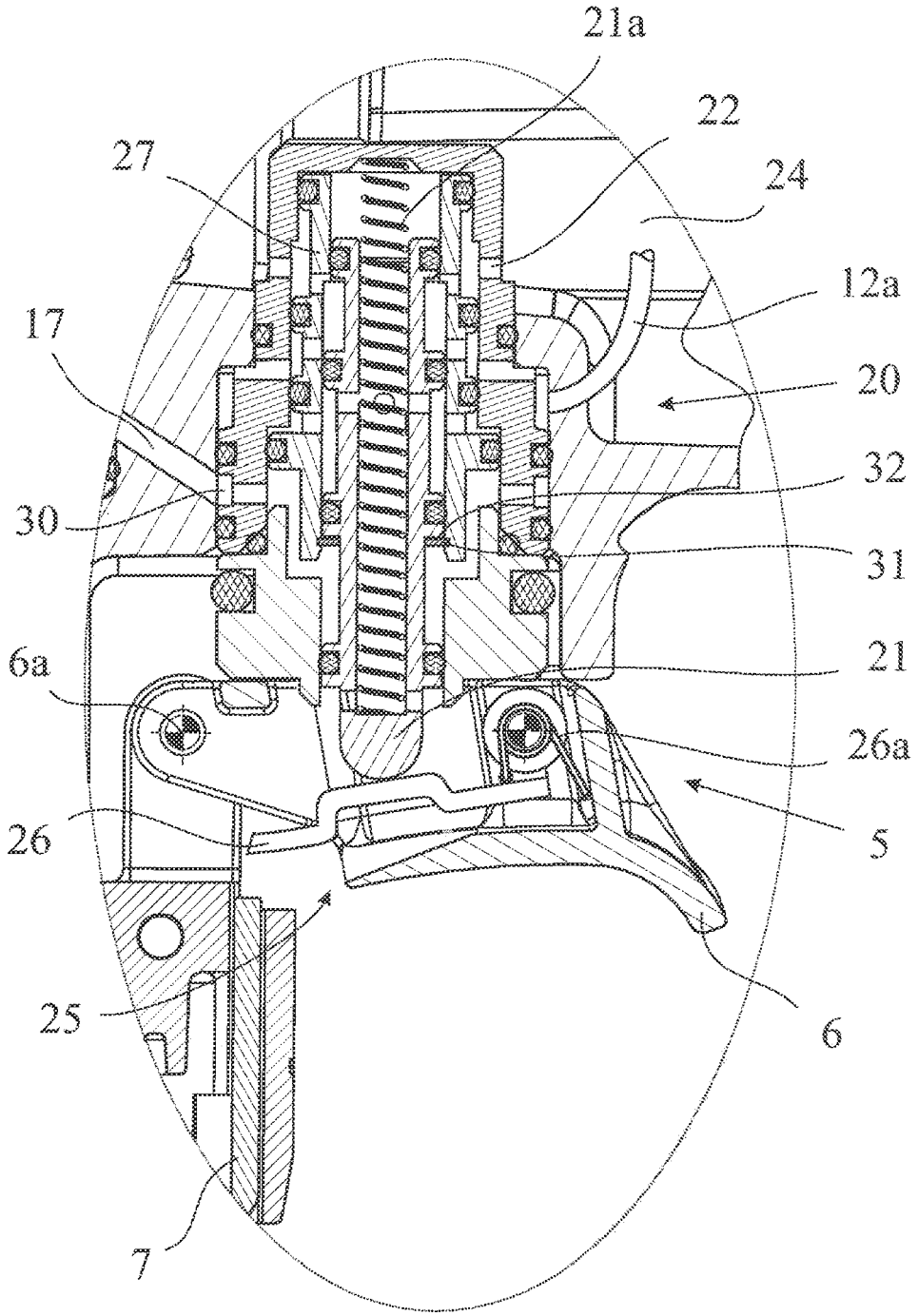
Figure 7:
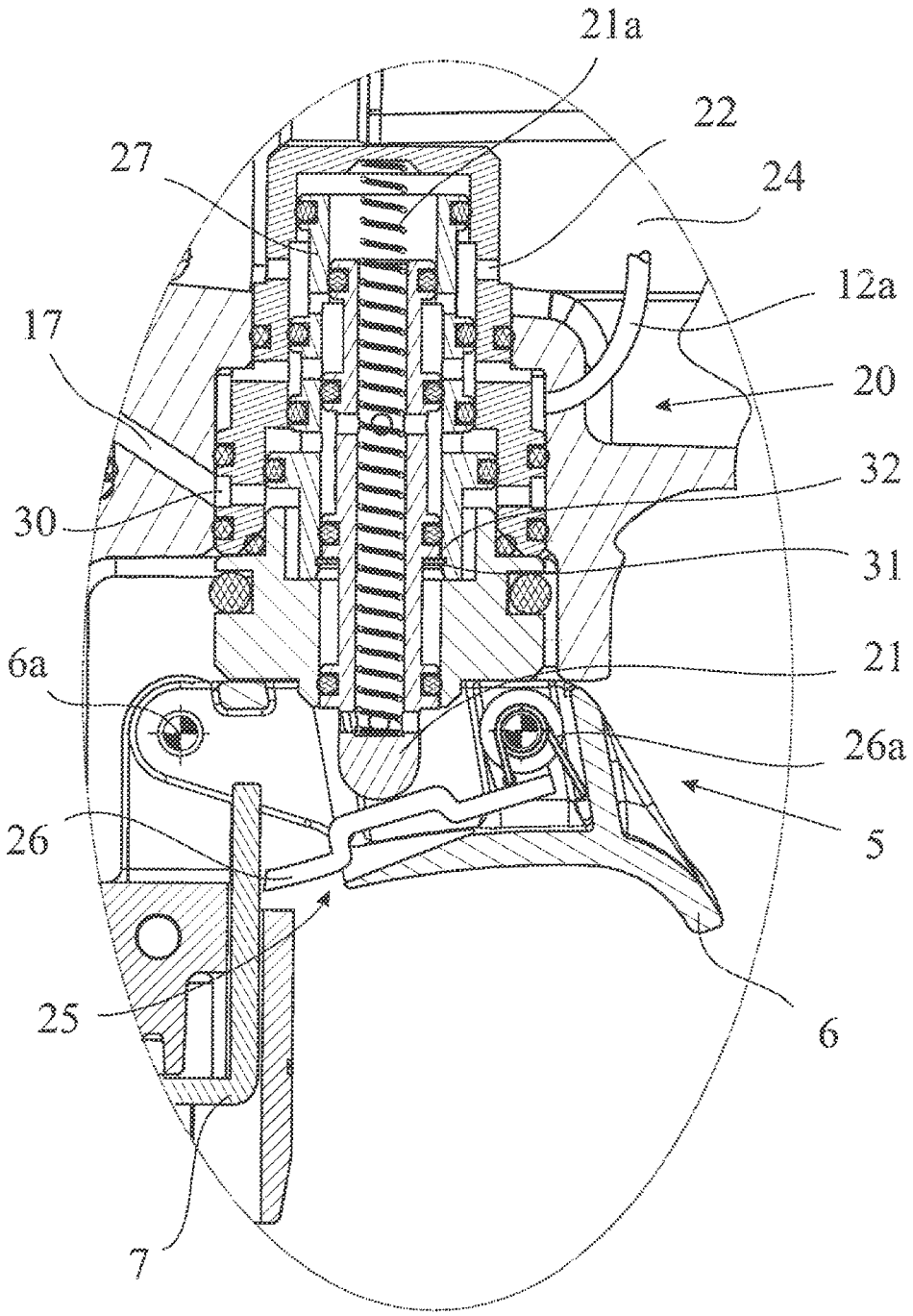
Figure 8:
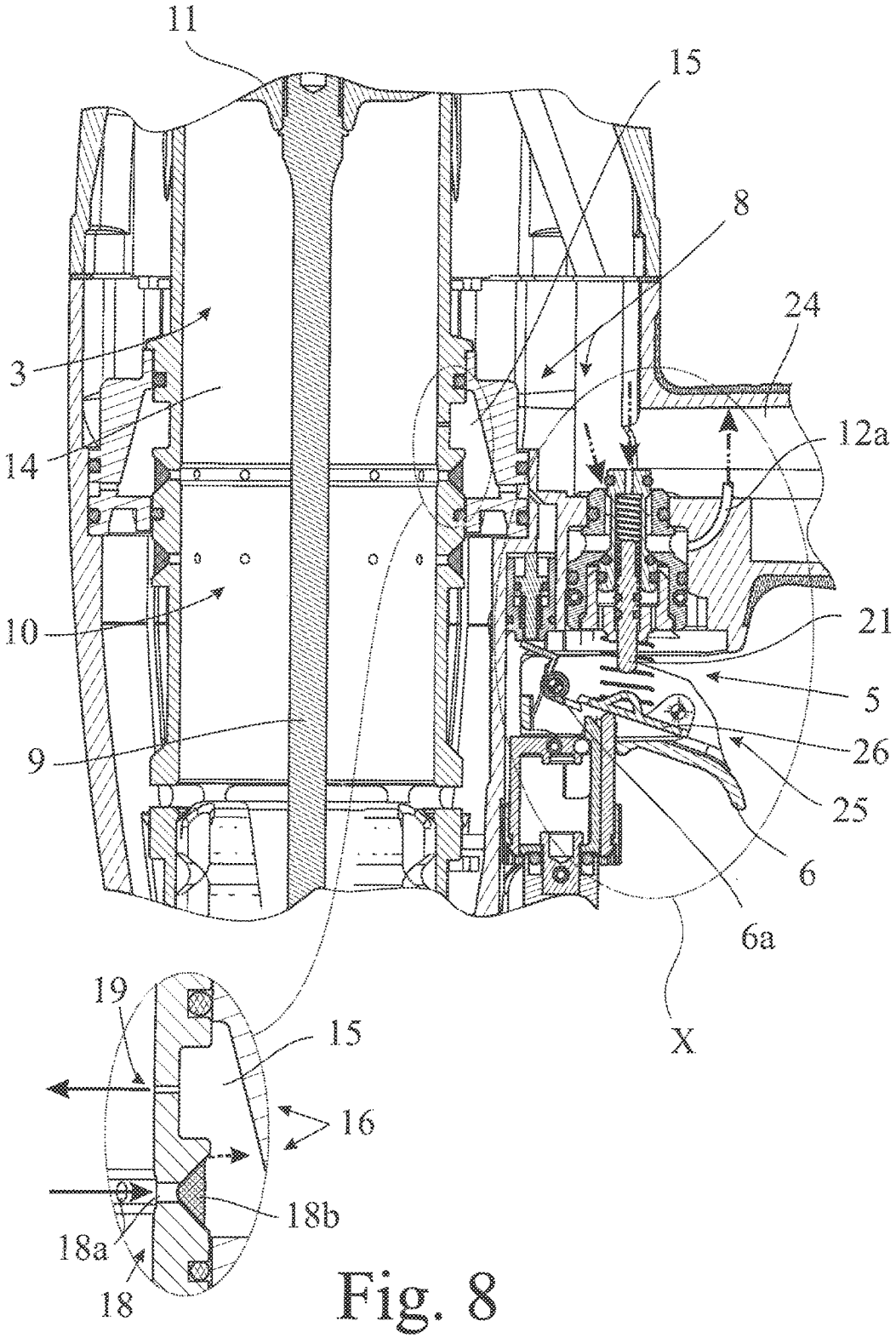
Figure 9:
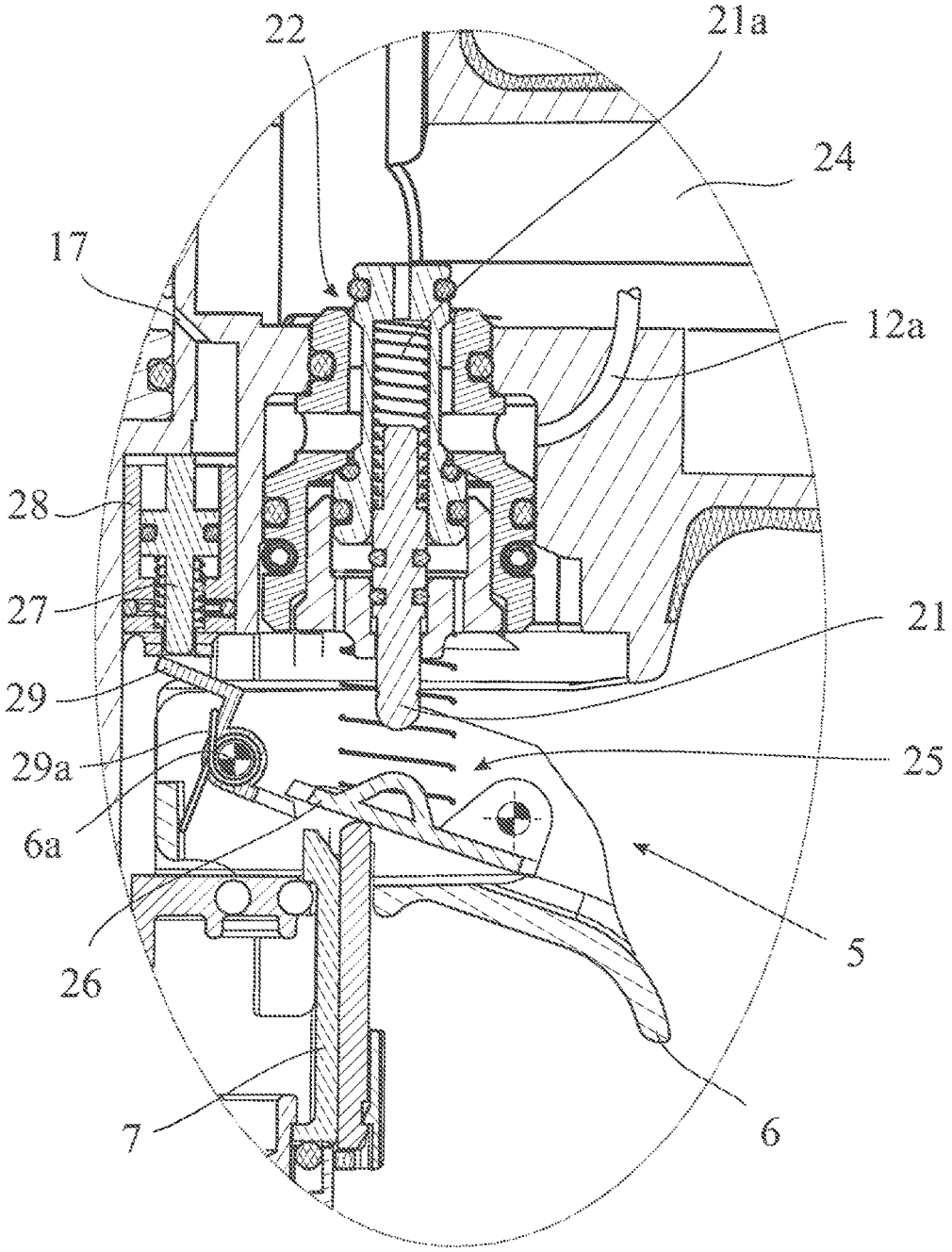
Figure 10:
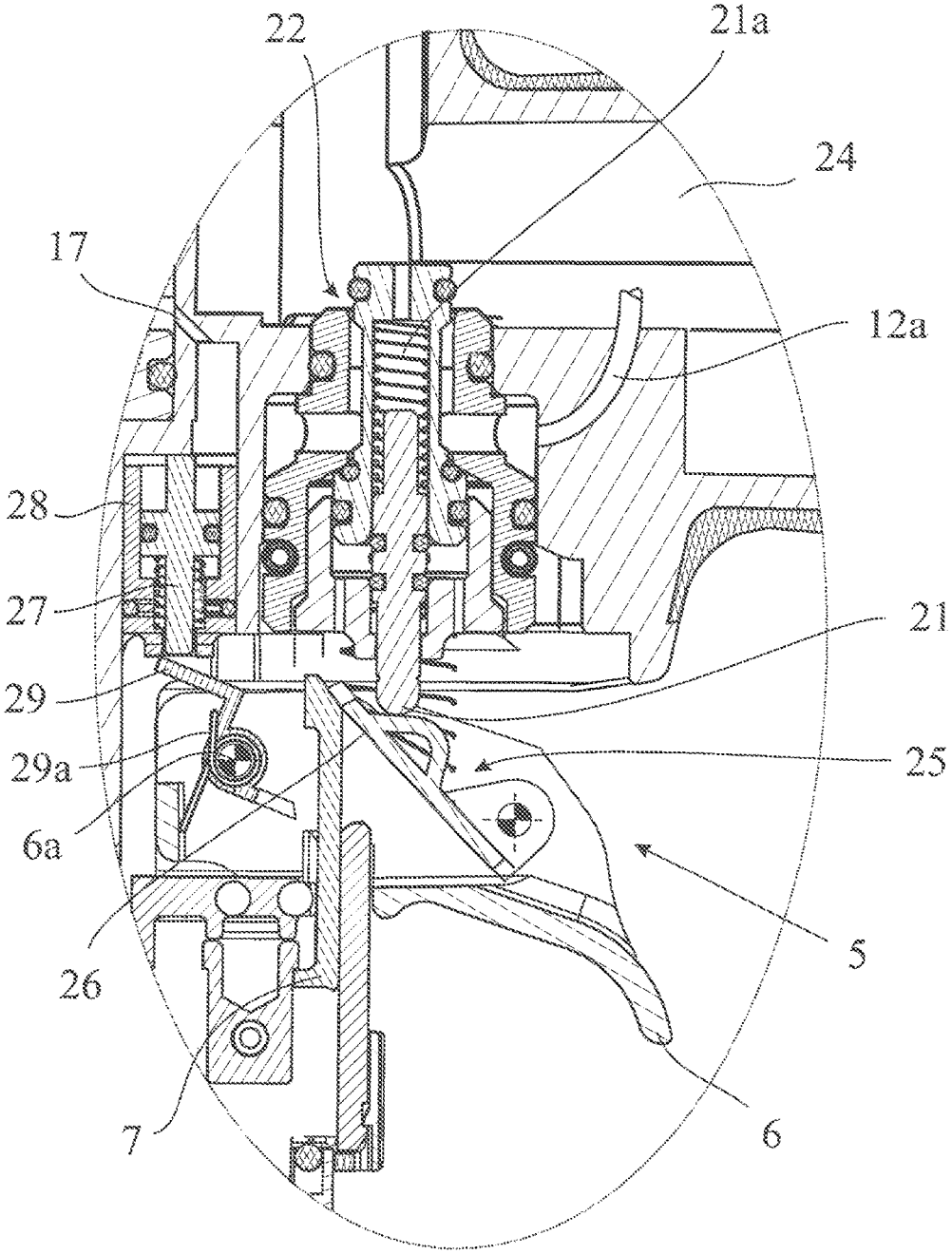
Figure 11:
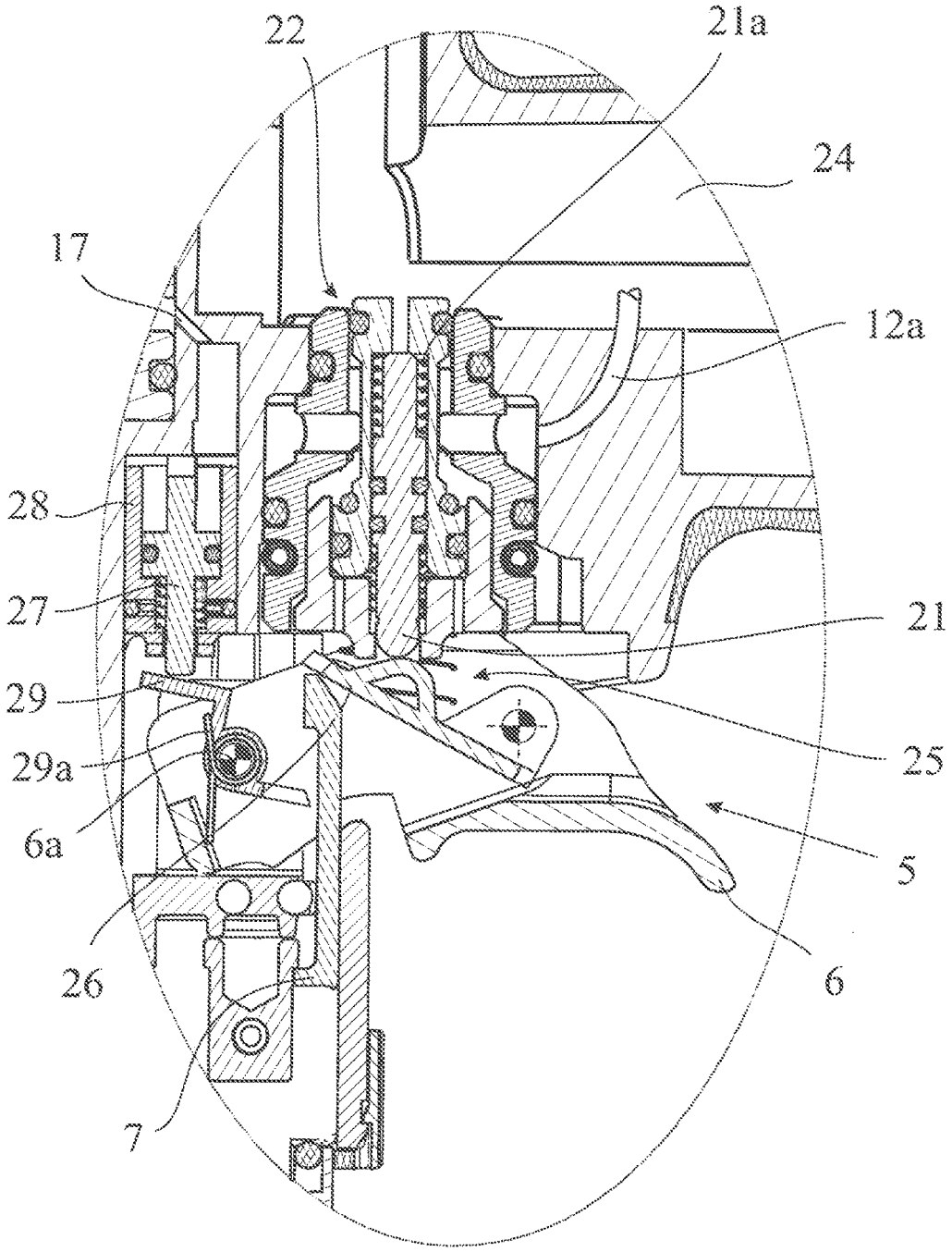
Figure 12:
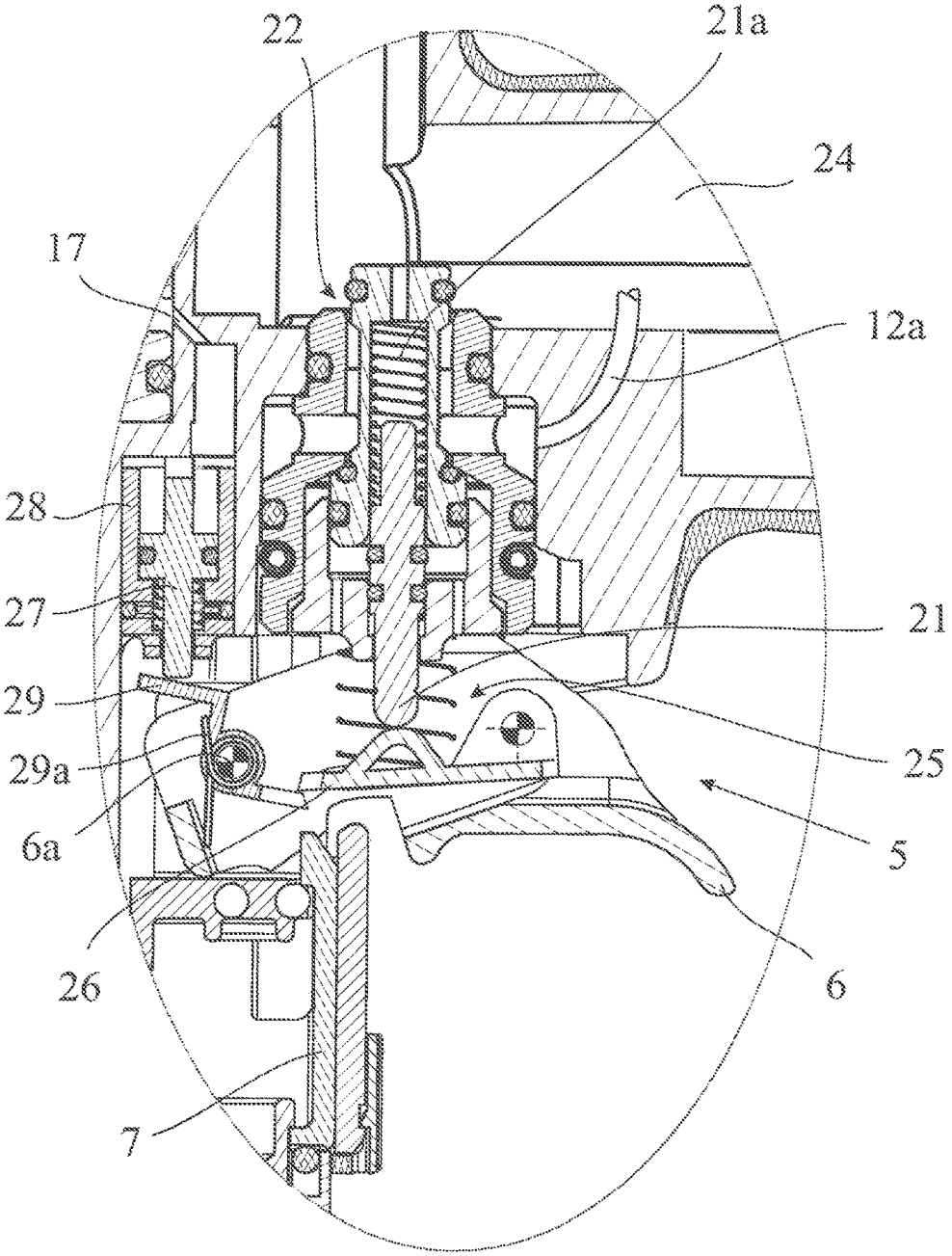
Figure 13:
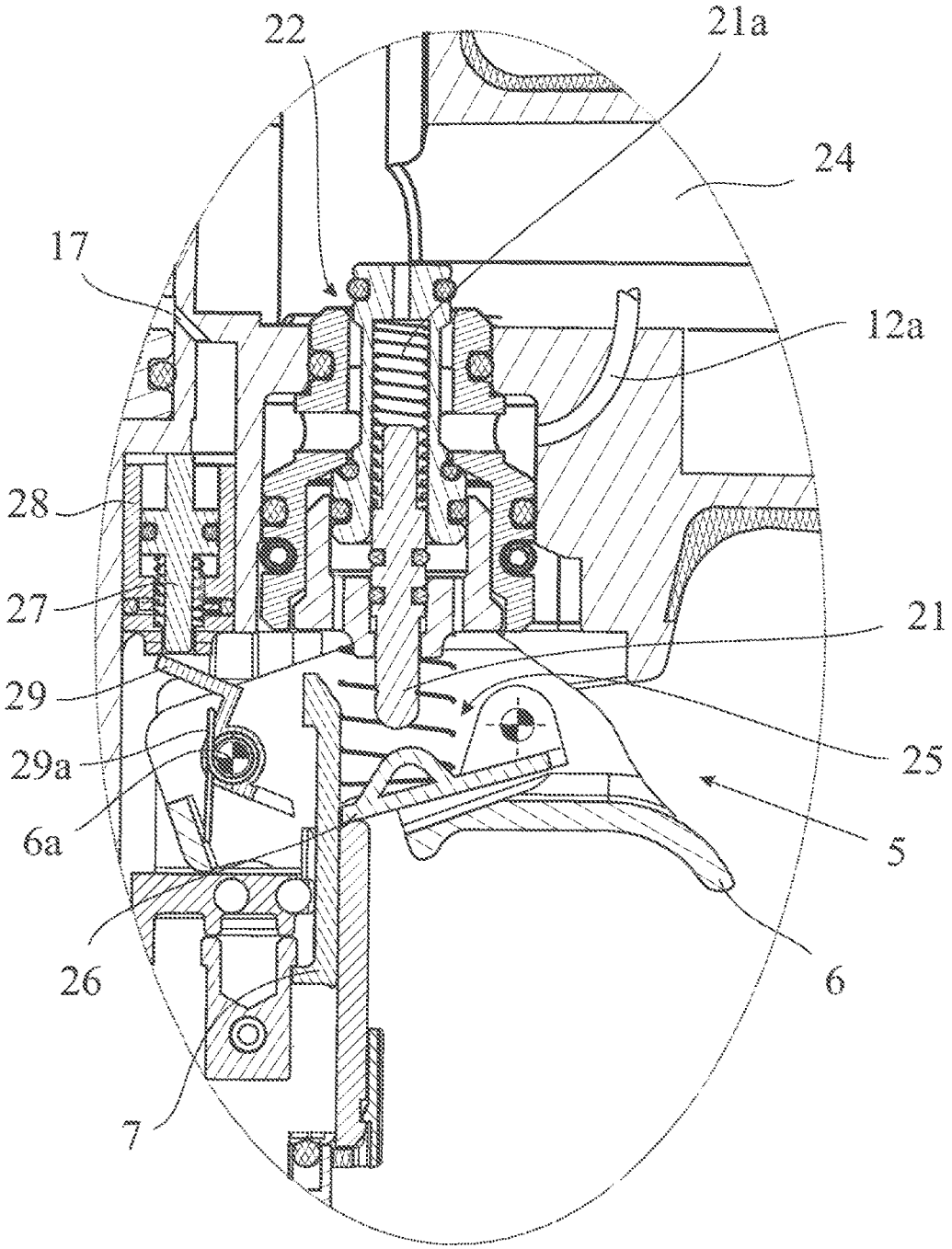

The invention is explained in more detail below on the basis of the drawings that merely show exemplary embodiments. In the drawings:

FIG. 1 shows a driving tool as proposed, in a side view,

FIG. 2 shows the driving tool according to FIG. 1, in the sectional view of a detail II, FIGS. 3-5 show the triggering sequence of the driving tool according to FIG. 2 from the single shot mode, in the sectional representation of a detail III, FIG. 6 shows the driving tool according to FIG. 2 in the bump firing mode, in the sectional representation of a detail III, FIG. 7 shows the driving tool according to FIG. 2 after the resetting from the situation represented in FIG. 6, in the partially sectional view of a detail III, FIG. 8 shows the driving tool according to FIG. 1 in a further embodiment, in the sectional view of a detail VIII, FIGS. 9-11 show the triggering sequence of the driving tool according to FIG. 8 from the single shot mode, in the sectional representation of a detail VIII and FIG. 12 shows the driving tool according to FIG. 8 in the bump firing mode, in the sectional representation of a detail VIII and FIG. 13 shows the driving tool according to FIG. 8 after the resetting from the situation represented in FIG. 12, in the partially sectional view of a detail VIII.

In the figures, the same reference signs/numerals are used for identical or similar components, even if a repeated description is omitted with for reasons of simplicity.

DETAILED DESCRIPTION

The driving tool that is represented in the drawing serves for driving in fastening means 1 of a magazine belt 2 indicated in FIG. 1, in particular nails, staples or the like. With regard to further interpretation of the term "fastening means", reference may be made to the introductory part of the description.

The driving in of nails is the main focus of attention in the description that follows, which should not be understood as being restrictive. All statements that are made with respect to nails apply correspondingly to all other types of fastening means that can be driven in.

The driving tool is provided with an actuator unit 3, by means of which the fastening means 1 can be driven into the workpiece W in driving-in cycles. Here and preferably, the actuator unit 3 is a pneumatic actuator unit 3, as still to be explained. In a driving-in cycle, the fastening means 1, driven by the actuator unit 3, pass through a driving channel 4 into the workpiece W.

The driving tool as proposed also has a triggering assembly 5, by means of which the driving-in cycles of the actuator unit 3 can be triggered. Correspondingly, the triggering assembly 5 first has a trigger lever 6, which can be actuated manually. The trigger lever 6 represented in the drawing can be pivoted about a trigger lever axis 6*a* for actuation.

In order to avoid unintentional triggering of driving-in cycles, the triggering assembly 5 is provided with a workpiece contact element 7, which can be actuated by the placing of the driving tool onto the workpiece W, that is to say by the placing of the workpiece contact element 7 onto the workpiece W. The workpiece contact element 7 can be resiliently deflected upward in FIG. 1 for actuation.

The driving tool can be operated in different operating modes, depending on the application. Firstly, the driving tool can be operated in a single shot mode, in which each individual sequence of an actuation of the workpiece contact element 7 with subsequent actuation of the trigger lever 6 triggers a driving-in cycle. In the single shot mode, the user therefore first places the driving tool onto the workpiece W, thereby actuating the workpiece contact element 7, and subsequently actuates the trigger lever 6.

If the fastening means 1 are to be driven in at a multiplicity of driving-in locations lying next to one another, the driving tool can be advantageously operated in bump firing mode. In bump firing mode, with the trigger lever 6 continuously actuated, each individual actuation of the workpiece contact element 7 triggers a driving-in cycle. If the user keeps the trigger lever 6 actuated, the placing of the driving tool, and consequently the actuation of the workpiece contact element 7, is sufficient for the triggering of a driving-in cycle.

It is preferably the case that the completely unactuated driving tool is initially in the single shot mode. This means that, for triggering the first driving-in cycle, first the workpiece contact element 7 and then the trigger lever 6 must be actuated. After this first driving-in cycle, the driving tool is preferably in the bump firing mode. The user then correspondingly has the possibility of keeping the trigger lever 6 actuated and triggering a further driving-in cycle with each actuation of the workpiece contact element 7.

The handling of the driving tool as proposed is made particularly convenient by the provision of a time-based, automatic transfer of the driving tool from the bump firing mode into the single shot mode. A resetting assembly 8, which can be activated in the bump firing mode and, after a delay time starting from the activation, has the effect of transferring the driving tool from the bump firing mode into the single shot mode, is specifically provided. The resetting assembly 8 therefore always determines the time that has elapsed since the activation. As soon as this time exceeds the predetermined delay time, the resetting assembly 8 initiates the transfer of the driving tool from the bump firing mode into the single shot mode. Here and preferably, the delay time lies in a range between approximately 2 s and approximately 4 s, preferably at approximately 3 s.

What is essential for the solution as proposed is that the resetting assembly 8 is coupled to the actuator unit 3 in such a way that, in the bump firing mode, a driving-in cycle activates the resetting assembly 8.

As explained further above, the solution as proposed can be used for all types of driving tools, as long as the activation of the resetting assembly 8 takes place by way of the coupling to the actuator unit by a driving-in cycle.

In the case of both exemplary embodiments that are represented, the actuator unit 3 has a driving punch 9, which during the driving-in cycle performs a linear driving-in movement, a movement from top to bottom in the drawing, and drives the respective fastening means 1 in. Subsequently, the driving punch 9 performs a return movement, a movement from bottom to top in the drawing. In principle, it may thus be provided that the resetting assembly 8 is coupled to the driving punch 9, or to a component connected thereto, for activation. Here and preferably, this coupling is however pneumatically provided, as explained below.

In the case of the exemplary embodiment that is represented and preferred to this extent, the actuator unit 3 has a working cylinder 10, in which a working piston 11 connected to the driving punch 9 runs, the resetting assembly 8 being coupled to the working cylinder 10, here and preferably pneumatically, for activation. In other preferred exemplary embodiments, it may also be provided that the resetting assembly 8 is in turn coupled to the driving punch 9 or to the working piston 11.

As already indicated, the driving tool represented is designed as a compressed-air driving tool, the resetting assembly 8 being pneumatically coupled to the actuator unit 3, here and preferably to the working cylinder 10 of the actuator unit 3.

Preferably provided for the driving-in movement of the working piston 11 is a main valve 12, which, triggered by the triggering assembly 5, admits air at a working pressure to the driving volume 13 of the working cylinder 10 for triggering a driving-in cycle. The "driving volume 13" should be understood as meaning in each case the region of the working cylinder 10 that is bounded by the working piston 11 and to which a positive pressure is applied for producing the driving-in movement. "Working pressure" means a pressure lying above atmospheric pressure that is suitable for implementing the driving-in movement of the working piston 11.

After the driving-in movement of the driving punch 9, that is to say after the driving of the respective fastening means 1 into the workpiece W, air is vented from the driving volume 13 of the working cylinder 10, here and preferably against atmospheric pressure. At the same time, a certain driving pressure is applied to the portion 14 of the working cylinder 10 beyond the driving volume 13, with respect to the working piston 11, thereby implementing the return movement of the working piston 11. The teaching as proposed does not specifically rely on the implementation of the driving-in movement and the return movement, and so to this extent there is no need for a detailed explanation.

Both in the first exemplary embodiment (FIGS. 2-7) and in the second exemplary embodiment (FIGS. 8-13), the resetting assembly 8 has a control volume 15, which is pneumatically coupled to the working cylinder 10 by way of a connection 16 and to the triggering assembly 5 by way of a connection 17. The term "connection" should be understood here in a broad sense in each case, and, apart from customary connecting lines, also comprises valves, nozzles or the like.

During the driving-in cycle, in particular during at least part of the driving-in movement of the driving punch 9, air at operating pressure is admitted to the control volume 15 by way of the working cylinder 10 and the connection 16. After the driving-in movement of the driving punch 9, air is vented from the control volume 15 against atmospheric pressure by way of the working cylinder 10.

For admitting air to the control volume 15, an air-admitting assembly 18 is provided in the wall of the working cylinder 10. The air-admitting assembly 18 can be seen best in the representation of a detail according to FIG. 2. The air-admitting assembly 18 is designed as a simple check valve. What is essential in this respect is that the wall of the working cylinder 10 has openings 18*a*, which are closed by a compliant ring 18*b*. When a working pressure is applied to the driving volume 13, the ring 18*b* is pressed out of engagement with the openings 18*a*, and so the admission of air at the working pressure to the control volume 15 can take place.

For the venting of air from the control volume 15, an air-venting assembly 19 is provided on the wall of the working cylinder 10, and is designed here as a simple opening. In principle, the air-venting assembly 19 may, however, also be designed as a valve, in particular as an adjustable needle valve or the like.

The design of the air-admitting assembly 18 on the one hand and of the air-venting assembly 19 on the other hand are of most particular importance in the present case. It should be taken into consideration in this respect that the admission of air 18 should take place with as little flow resistance as possible, while the venting of air should take place in such a way that the pressure in the control volume 15 only goes below the limit value, still to be explained, when the predetermined delay time has elapsed.

What is interesting about the exemplary embodiments represented is the fact that in any event the air-venting assembly 19 is flowed through in a first flow direction during the driving-in cycle and is flowed through in a second flow direction, opposite from the first flow direction, during the venting of air from the control volume 15. This ensures that contamination of the air-venting assembly 19 is largely avoided.

Advantageously, the air-admitting assembly 18 and the air-venting assembly 19 may also be combined in a single valve assembly. This leads to a structurally particularly simple embodiment.

The structural design of the control volume 15 is of most particular importance in the present case. Here and preferably, the control volume 15 is arranged annularly around the working cylinder 10. This allows an arrangement that is optimized in terms of installation space to be achieved, as FIGS. 2 and 8 show. In principle, however, a different arrangement of the control volume 15 is also conceivable.

Among other influencing factors, the control volume 15 together with the air-venting assembly 19 are determinant for the resulting delay time of the resetting assembly 8. For this, the control volume 15 is assigned a pressure limit value, the driving tool remaining in the bump firing mode when the pressure is above the limit value, by way of the pneumatic coupling to the triggering assembly 5, and a fall in the pressure below the limit value defining the elapse of the delay time and having the effect of transferring the driving device into the single shot mode, by way of the pneumatic coupling to the triggering assembly 5. The pressure limit value may have a fixed value or else vary in dependence on various boundary conditions, such as the level of the working pressure.

Depending on the pressure prevailing in the control volume 15, the pneumatic coupling to the triggering assembly 5 therefore has the effect of keeping the driving device in the bump firing mode or transferring the driving device into the single shot mode. This is explained below on the basis of the two exemplary embodiments.

In the two exemplary embodiments represented, the triggering assembly 5 has a triggering valve 20 with a valve piston 21, which valve piston 21 can be actuated from a starting position (FIGS. 3 and 9) into an actuating position (FIGS. 5 and 11). The valve piston 21 is pre-stressed into the starting position by means of a valve piston spring 21*a*. The starting position corresponds to a certain extent to a rest position of the triggering valve 20, in which no driving-in cycle is triggered by the triggering assembly 5. In the actuating position, the triggering valve 20 has the effect that air at working pressure is admitted to the driving volume 13 of the working cylinder 10, here and preferably by way of the main valve 12. The assembly comprising the main valve 12 and the triggering valve 20 is thus arranged in such a way that, as long as the triggering valve 20 switches through the working pressure to the main valve 12, the main valve 12 remains closed, that is to say air at operating pressure is not admitted to the driving volume 13. Only when the triggering valve 20 interrupts the application of working pressure to the main valve 12 does the main valve 12 admit air at working pressure to the driving volume 13 of the working cylinder 10.

For the above activation of the main valve 12, the triggering valve 20 is provided with an upper valve inlet 22, to which working pressure is applied. Working pressure is fed here to the upper valve inlet 22 of the triggering valve 20 by way of the connection 23 and the gripping portion 24.

What is essential in this context is that an adjustment of the valve piston 21 of the triggering valve 20 into the actuating position triggers an aforementioned driving-in cycle.

Depending on the respective operating mode of the driving tool, the valve piston 21 can be adjusted by a specific actuation of the trigger lever 6 on the one hand and the workpiece contact element 7 on the other hand into the actuating position. For this, the triggering assembly 5 is provided with a coupling assembly 25, which, with the trigger lever 6 actuated, provides a coupling or disengagement between the workpiece contact element 7 and the valve piston 21, depending on the position of the valve piston 21.

What is essential here is firstly that, with the trigger lever 6 actuated, the coupling of the workpiece contact element 7 to the triggering assembly 5 otherwise depends on the position assumed by the valve piston 21 of the triggering valve 20. For example, in the case of the state that is represented in FIGS. 7 and 13, it is such that the valve piston 21 is in the starting position, and so, with the trigger lever 6 actuated, an actuation of the workpiece contact element 7 is disengaged. On the other hand, FIGS. 6 and 12 show that the valve piston 21 can be brought into an intermediate position, which is located between the starting position and the actuating position, in which, with the trigger lever 6 actuated, an actuation of the workpiece contact element 7 has the effect of adjusting the valve piston 21 into the actuating position.

Numerous structural variants are conceivable for the design of the coupling assembly 25. Here and preferably, the coupling assembly 25 is provided with a pivotable coupling element 26, which is pivotably mounted on the trigger lever 6. The coupling element 26 is preferably assigned a coupling element spring 26*a*, which pre-stresses the coupling element 26 onto the valve piston 21 of the triggering valve 20. This produces a coupling of movement between the valve piston 21 and the coupling element 26.

It is also preferably the case that, with the trigger lever 6 not actuated, the workpiece contact element 7 interacts with the coupling assembly 25, here and preferably with the coupling element 26 of the coupling assembly 25, in such a way that an actuation of the trigger lever 6 following the actuation of the workpiece contact element 7 has the effect of adjusting the valve piston 21 into the actuating position. This is evident from the sequence of FIGS. 4 and 5.

What is interesting about the two exemplary embodiments represented is the fact that the resetting assembly 8 has a pneumatically adjustable control element 27, which is pneumatically coupled to the control volume 15. When the pressure in the control volume 15 is above the limit value, the pneumatically adjustable control element 27 interacts with the valve piston 21 (FIGS. 2-7) or with the coupling assembly 25 (FIGS. 8-13) in such a way that, with the trigger lever 6 actuated, an actuation of the workpiece contact element 7 actuates the valve piston 21 into its actuating position (FIGS. 6 and 12). On the other hand, when the pressure in the control volume 15 goes below the limit value, the pneumatically adjustable control element 27 interacts with the valve piston 21 (FIGS. 2-7) or the coupling assembly (FIGS. 8-13) in such a way that, with the trigger lever 6 actuated, an actuation of the workpiece contact element 7 is disengaged (FIGS. 7 and 13).

Numerous advantageous variants are conceivable for the structural design of the pneumatically adjustable control element 27. In the case of the exemplary embodiment that is represented in FIGS. 2-7, the pneumatically adjustable control element 27 is designed as a pneumatically adjustable control sleeve, which is arranged concentrically in relation to the valve piston 21 of the triggering valve 20, the control sleeve 27 coming into engagement with the valve piston 21 and keeping the valve piston 21 in its intermediate position (FIG. 6) when the pressure in the control volume 15 exceeds the limit value.

Alternatively, and shown in FIGS. 8-13, the pneumatically adjustable control element 27 may be designed as a pneumatic drive piston, which runs in a drive cylinder 28 that is separate from the triggering valve 20. In the case of the exemplary embodiment that is represented and to this extent preferred, arranged between the pneumatically adjustable control element 27 and the coupling assembly 25 is an intermediate lever 29, here and preferably an intermediate lever 29, which is structurally simple and robust.

In the description that follows, the functioning principles of the two exemplary embodiments are explained on the basis of the single shot mode.

FIG. 3 shows the completely unactuated state of the driving tool according to the first preferred embodiment. Working pressure is applied to the connection 12*a*, only indicated here, to the main valve 12, and so the main valve 12 is blocked as mentioned above.

As shown in FIG. 4, an actuation of the workpiece contact element 7 leads to a pivoting of the coupling element. Operating pressure continues to be applied to the connection 12*a* to the main valve 12. A subsequent actuation of the trigger lever 6 brings about a further adjustment of the coupling element 26, with at the same time support on the workpiece contact element 7 in such a way that the valve piston 21 reaches its actuating position. In this position, the connection 12*a* to the main valve 12 is disconnected from the working pressure, which leads to the triggering of a driving-in cycle.

During the driving-in cycle, as explained above, working pressure is applied to the driving volume 13 of the working cylinder 10 by way of the main valve 12, and so the working piston 11 runs downward in FIG. 2. As soon as the working piston 11 has passed the air-admitting assembly 18, the working pressure located in the driving volume 13 provides an admission of air to the control volume 15 by way of the air-admitting assembly 18. The working pressure is established in the lower valve inlet 30 of the triggering valve 20 by way of the connection 17 between the control volume 15 and the triggering assembly 5. Although working pressure is likewise applied to the upper valve inlet 22 of the triggering valve 20, the geometrical conditions of the surface areas of the pneumatically adjustable control element 27 to which pressure is applied are such that the pneumatically adjustable control element 27 runs upward in FIG. 5 into its holding position.

Even if then, as shown in FIG. 6, the workpiece contact element 7 assumes its unactuated position, the valve piston 21 is kept in the intermediate position shown in FIG. 6 by the pneumatically adjustable control element 27. For this, the pneumatically adjustable control element 27 is provided with a snap ring 31 and the valve piston 21 is provided with an offset 32.

In the state that is shown in FIG. 6, the driving tool is in the bump firing mode, in which every actuation of the workpiece contact element 7 triggers a driving-in cycle, as long as the trigger lever 6 is actuated. With each driving-in cycle, air is newly admitted to the control volume 15, and so the pneumatically adjustable control element 27 continuously keeps the valve piston 21 in the intermediate position that is shown in FIG. 6.

Only when no driving-in cycle has been triggered over the predetermined delay time does the resetting assembly 8 transfer the driving tool into the single shot mode. This is the case when the pressure in the control volume 15 goes below the pressure limit value on account of the venting of air from the control volume 15 by way of the air-venting assembly 19. In this case, the application of working pressure to the upper valve inlet 22 of the triggering valve 20 has the effect of adjusting the pneumatically adjustable control element 27 into the resetting position that is represented in FIG. 7. Correspondingly, the valve piston 21 also falls into its starting position in a spring- and pressure-driven manner. With the trigger lever 6 pulled, this means that the coupling assembly 25 otherwise decouples the workpiece contact element 7 from the triggering assembly 5. This can be seen from the representation according to FIG. 7.

The functional principle of the second exemplary embodiment is similar in terms of effect. To this extent, only those aspects of the second exemplary embodiment that differ from the functional principle of the first exemplary embodiment are discussed below.

Like FIG. 3, FIG. 9 shows the completely unactuated state of the driving tool. An actuation of the workpiece contact element 7 leads to a slight adjustment of the coupling element 26 on the one hand and of the valve piston 21 of the triggering valve 20 on the other hand. Working pressure is applied to the connection 12*a* between the triggering valve 20 and the main valve 12, and so the main valve 12 is blocked. Only when the trigger lever 6 is additionally actuated is the working pressure no longer applied to the connection 12*a* to the main valve 12, which leads to a triggering of a driving-in cycle.

As in the case of the first exemplary embodiment, the driving-in cycle has the effect that air at operating pressure is admitted to the control volume 15, which results in the pneumatically adjustable control element 27 being transferred from a resetting position into the holding position represented in FIG. 11, by way of the connection 17. As long as the pressure in the control volume 15 is above the pressure limit value, the pneumatically adjustable control element 27 is in the holding position, as shown in FIG. 12. In this holding position, the pneumatically adjustable control element 27 interacts by way of an intermediate lever 29, which is pre-stressed toward the pneumatically adjustable control element 27 by means of an intermediate lever spring 29*a*, with the coupling element 26 in such a way that the coupling element 26 otherwise couples the workpiece contact element 7 to the triggering assembly 5. Every actuation of the workpiece contact element 7 thus leads to the triggering of a driving-in cycle, as long as the trigger lever 6 is actuated.

Only when the pressure within the control volume 15 goes below the limit value due to the venting of air by way of the air-venting assembly 19 does the pneumatically adjustable control element 27 go into its resetting position, as represented in FIG. 13, in a spring- and pressure-driven manner. As a result, the intermediate lever 29 comes out of engagement with the coupling element 26, which falls into the position that is represented in FIG. 13. This has the effect that the workpiece contact element 7 is otherwise decoupled from the triggering assembly 5, and so, with the trigger lever 6 actuated, an actuation of the workpiece contact element 7 is disengaged. The driving tool has thus been transferred by means of the resetting assembly 8 from the bump firing mode into the single shot mode.

According to a further teaching, which is likewise of independent significance, a driving tool for driving in fastening means 1 is disclosed. An actuator unit 3 is provided, by means of which the fastening means 1 can be driven into the workpiece W in driving-in cycles, a triggering assembly 5 being provided, by means of which the driving-in cycles of the actuator unit 3 can be triggered. The triggering assembly 5 has a trigger lever 6, which can be actuated manually, and a workpiece contact element 7, which can be actuated by placing the driving tool onto the workpiece W.

As explained above, the driving tool can be operated in a single shot mode and in a bump firing mode. Also provided is a resetting assembly 8, which can be activated in the bump firing mode and, after a delay time starting from the activation, has the effect of transferring the driving tool from the bump firing mode into the single shot mode.

What is essential according to this further teaching is that the resetting assembly 8 has a control volume 15, the resetting assembly 8 having a pneumatically adjustable control element 27, which is pneumatically coupled to the control volume 15, the pneumatically adjustable control element 27 interacting with the triggering assembly 5 when the pressure in the control volume 15 goes below a limit value in such a way that, with the trigger lever 6 actuated, actuation of the workpiece contact element 7 is disengaged.

Reference may be made to all statements that have been made, in particular the statements made in relation to the design of the pneumatically adjustable control element 27, this further teaching not necessarily relying on the resetting assembly 8 being coupled to the actuator unit 3 in such a way that, in the bump firing mode, a driving-in cycle activates the resetting assembly 8.

The invention claimed is:

1. A driving tool for driving fastening means into a workpiece by driving-in cycles, comprising:

an actuator unit for driving the fastening means into the workpiece, wherein the actuator unit includes a working cylinder with an associated working piston connected to a driving punch, wherein the working piston is movable linearly along the working cylinder to move the driving punch during each driving-in cycle;

a triggering assembly for triggering each driving-in cycle of the actuator unit, the triggering assembly having a manually actuatable trigger lever, a workpiece contact element that is actuatable by placing the driving tool onto the workpiece, and a trigger valve with a valve piston movable between a non-actuating position that does not trigger movement of the working piston and an actuating position that triggers application of a working pressure to a driving volume of the working cylinder to move the working piston;

wherein each individual sequence of an actuation of the workpiece contact element with subsequent actuation of the trigger lever causes movement of the valve piston to the actuating position in order to trigger one of the driving-in cycles according to a single shot mode of the driving tool, wherein, with the trigger lever continuously actuated, each individual actuation of the workpiece contact element causes movement of the valve piston to the actuating position to trigger one of the driving-in cycles according to a bump firing mode of the driving tool, a resetting assembly for resetting the driving tool from the bump firing mode to the single shot mode, wherein the resetting assembly includes a control volume that is coupled by a fluid path to the working cylinder, wherein the resetting assembly is activated in the bump firing mode by movement of the working piston and the driving punch during each driving-in cycle so that the fluid path from the working cylinder to the control volume applies the working pressure to the control volume, wherein the resetting assembly is configured such that, after a delay time starting from activation of the resetting assembly and determined by a pressure in the control volume falling below a limit value due to venting of air from the control volume, the resetting assembly automatically causes switching of the driving tool from the bump firing mode into the single shot mode by preventing actuation of the workpiece contact element from moving the valve piston to the actuating position so long as the trigger lever remains continuously actuated.

2. The driving tool as claimed in claim 1, wherein, during each driving-in cycle, the driving punch performs a linear driving-in movement and subsequently performs a linear return movement, wherein the driving tool is designed as a compressed-air driving tool and a main valve is provided, and the main valve, which is triggered by movement of the valve piston to the actuating position, admits air at the working pressure to the driving volume of the working cylinder.

3. The driving tool as claimed in claim 1, wherein air is vented from the control volume by way of the working cylinder, against atmospheric pressure.

4. The driving tool as claimed in claim 3, wherein the fluid path includes an air-admitting assembly in a wall of the working cylinder, wherein the air-admitting assembly includes a check valve.

5. The driving tool as claimed in claim 1, wherein the triggering assembly has a coupling assembly, which, with the trigger lever actuated, provides a coupling or disengagement between the workpiece contact element and the valve piston, depending on the position of the valve piston, wherein the valve piston is configured to be brought into an intermediate position in which, with the trigger lever actuated, an actuation of the workpiece contact element has the effect of adjusting the valve piston into the actuating position.

6. The driving tool as claimed in claim 5, wherein, with the trigger lever not actuated, the workpiece contact element interacts with a coupling element of the coupling assembly, wherein actuation of the trigger lever following the actuation of the workpiece contact element has the effect of adjusting the valve piston into the actuating position.

7. The driving tool as claimed in claim 6, wherein the coupling assembly has a pivotable coupling element, which is pivotably mounted on the trigger lever.

8. The driving tool as claimed in claim 5, wherein the resetting assembly has a pneumatically adjustable control element, which is pneumatically coupled to the control volume and, in response to the pressure in the control volume exceeding the limit value, the pneumatically adjustable control element interacts with the valve piston and/or the coupling assembly with the trigger lever actuated, an actuation of the workpiece contact element actuates the valve piston into its actuating position and, in response to the pressure in the control volume going below a limit value, the pneumatically adjustable control element interacts with the valve piston and/or the coupling assembly, wherein with the trigger lever actuated, an actuation of the workpiece contact element is disengaged from actuating the valve piston into its actuating position.

9. The driving tool as claimed in claim 8, wherein the pneumatically adjustable control element is designed as a pneumatically adjustable control sleeve, which is arranged concentrically in relation to the valve piston of the triggering valve and which comes into engagement with the valve piston and keeps the valve piston in its intermediate position in response to the pressure exceeding the limit value.

10. A driving tool for driving fasteners into a workpiece, comprising:

an actuator unit for driving fasteners into the workpiece in driving-in cycles, wherein the actuator unit includes a working cylinder with an associated working piston connected to a driving punch, wherein the working piston is movable linearly along the working cylinder to move the driving punch, wherein, for each driving-in cycle, the driving punch of the actuator unit moves in a linear driving-in movement to engage and drive a fastener and subsequently performs a linear return movement;

a triggering assembly configured for triggering each driving-in cycle of the actuator unit, the triggering assembly having a manually actuatable trigger lever, a workpiece contact element, wherein the workpiece contact element is configured to be actuated by placing the driving tool onto the workpiece, and a trigger valve with a non-actuating configuration that does not trigger movement of the working piston and an actuating configuration that triggers application of a working pressure to a driving volume of the working cylinder to move the working piston;

wherein the driving tool is operable in a single shot mode, in which each individual sequence of an actuation of the workpiece contact element with subsequent actuation of the trigger lever triggers one of the driving-in cycles by moving the trigger valve into the actuating configuration;

wherein the driving tool is operable in a bump firing mode, in which, with the trigger lever continuously actuated, each individual actuation of the workpiece contact element triggers one of the driving-in cycles by moving the trigger valve into the actuating configuration;

a resetting assembly for resetting the driving tool from the bump firing mode to the single shot mode, wherein the resetting assembly includes a control volume that is coupled by a fluid path to the working cylinder, wherein the resetting assembly is activated in the bump firing mode by movement of the working piston and the driving punch during each driving-in cycle so that the fluid path from the working cylinder to the control volume applies the working pressure to the control volume, wherein the resetting assembly is configured such that, after a delay time starting from activation of the resetting assembly and determined by a pressure in the control volume falling below a limit value due to venting of air from the control volume, the resetting assembly switches the driving tool from the bump firing mode into the single shot mode by preventing actuation of the workpiece contact element from moving the trigger valve into the actuating configuration so long as the trigger lever remains continuously actuated.

11. The driving tool as claimed in claim 10, wherein the control volume extends annularly around the working cylinder.

12. A driving tool for driving fasteners into a workpiece, comprising:

an actuator unit configured for driving fasteners into the workpiece in driving-in cycles, wherein, for each driving-in cycle, a driving part of the actuator unit moves to engage and drive one of the fasteners;

a triggering assembly configured for triggering each driving-in cycle of the actuator unit, the triggering assembly having a manually actuatable trigger lever and a workpiece contact element, wherein the workpiece contact element is configured to be actuated by placing the driving tool onto the workpiece;

wherein the driving tool is operable in a single shot mode, in which each individual sequence of an actuation of the workpiece contact element with subsequent actuation of the trigger lever triggers movement of the driving part for one of the driving-in cycles;

wherein the driving tool is operable in a bump firing mode, in which, with the trigger lever continuously actuated, each individual actuation of the workpiece contact element triggers movement of the driving part for one of the driving-in cycles;

a resetting assembly for resetting the driving tool from the bump firing mode to the single shot mode, wherein the resetting assembly is activated in the bump firing mode by movement of the driving part, wherein the resetting assembly is configured such that, after a delay time starting from activation of the resetting assembly, the resetting assembly switches the driving tool from the bump firing mode into the single shot mode by preventing actuation of the workpiece contact element from triggering movement of the driving part so long as the trigger lever remains continuously actuated.

13. The driving tool as claimed in claim 12, wherein the driving part of the actuator unit moves along a working cylinder, wherein the resetting assembly has a control volume, which is pneumatically coupled to the working cylinder and to the triggering assembly, wherein the control volume extends annularly around the working cylinder.

14. The driving tool as claimed in claim 12, wherein the driving part of the actuator unit comprises a driving punch that is connected to a working piston that moves along a working cylinder via application of a working pressure in a driving volume of the working cylinder, wherein the resetting assembly has a control volume, which is pneumatically coupled to the working cylinder and to the triggering assembly, wherein an air-admitting assembly connects the working cylinder and the control volume, wherein the air-admitting assembly is positioned such that a movement of the driving punch and the working piston during driving-in cycles exposes the air-admitting assembly to the driving volume such that the working pressure of the driving volume moves air through the air-admitting assembly and into the control volume to activate the resetting assembly.

15. The driving tool of claim 14, wherein the delay time is determined by a pressure in the control volume falling below a limit value due to venting of air from the control volume.

16. The driving tool as claimed in claim 12, wherein the driving part of the actuator unit comprises a driving punch connected to a working piston that moves along a working cylinder via application of a working pressure in a driving volume of the working cylinder, wherein the resetting assembly has a control volume, wherein an air-admitting assembly connects the working cylinder and the control volume, wherein the air-admitting assembly is positioned such that, in the bump-firing mode, movement of the driving part and working piston during driving-in cycles exposes the air-admitting assembly to the driving volume such that the working pressure of the driving volume moves air through the air-admitting assembly and into the control volume to activate the resetting assembly, wherein the triggering assembly includes a trigger valve with a non-actuating configuration that does not trigger movement of the working piston and an actuating configuration that triggers application of a working pressure to a driving volume of the working cylinder to move the working piston;

wherein the control volume is pneumatically coupled to the triggering assembly, and a low pressure condition in the control volume prevents actuation of the workpiece contact element from moving the trigger valve into the actuating configuration so long as the trigger lever remains continuously actuated.

17. The driving tool as claimed in claim 12, wherein the driving part of the actuator unit comprises a driving punch connected to a working piston that moves along a working cylinder via application of a working pressure in a driving volume of the working cylinder, wherein the resetting assembly includes a control volume that is coupled by a fluid path to the working cylinder, wherein the resetting assembly is activated in the bump firing mode by movement of the working piston and the driving punch during each driving-in cycle so that the fluid path from the working cylinder to the control volume applies the working pressure to the control volume;

wherein the triggering assembly further includes a coupling element pivotably mounted to the trigger lever, wherein, in the bump firing mode, the coupling element is positioned to be contacted by actuation of the workpiece contact element so long as a pressure of the control volume remains above a limit value and the coupling element moves to a position to avoid being contacted by actuation of the workpiece contact element if the pressure of the control volume falls below the limit value resulting in switching the driving tool from the bump firing mode into the single shot mode.

* * * * *